US005978637A

United States Patent [19]

Sakai et al.

[11] Patent Number: 5,978,637

[45] Date of Patent: Nov. 2, 1999

[54] IMAGE FORMING APPARATUS CAPABLE OF OBTAINING STABLE TRANSFER USING A PARTICULAR TRANSFER ROLLER

[75] Inventors: Tetsuya Sakai, Aichi-ken; Yasuo Tanaka, Okazaki; Koji Uno, Toyokawa; Kazuyoshi Hara, Toyohashi, all of Japan

[73] Assignee: Minolta Co., Ltd., Osaka, Japan

[21] Appl. No.: 08/956,365

[22] Filed: Oct. 23, 1997

[30] Foreign Application Priority Data

Oct. 31, 1996 [JP] Japan ..... 8-289644

[51] Int. Cl.[6] ..... G03G 15/01

[52] U.S. Cl. ..... 399/302; 399/313

[58] Field of Search ..... 399/313, 314, 399/308, 302, 66

[56] References Cited

U.S. PATENT DOCUMENTS

| | | | |
|---|---|---|---|
| 3,781,105 | 12/1973 | Meagher | 399/314 |
| 4,379,630 | 4/1983 | Suzuki | 399/313 |
| 5,132,738 | 7/1992 | Nakamura et al. | 399/101 |
| 5,571,457 | 11/1996 | Vreeland et al. | 252/519 |
| 5,701,569 | 12/1997 | Kanazawa et al. | 399/308 |

FOREIGN PATENT DOCUMENTS

| | | |
|---|---|---|
| 4-25885 | 1/1992 | Japan . |
| 5-011636 | 1/1993 | Japan . |
| 5-241363 | 9/1993 | Japan . |
| 5-241458 | 9/1993 | Japan . |
| 5-249849 | 9/1993 | Japan . |
| 5-249850 | 9/1993 | Japan . |
| 5-249851 | 9/1993 | Japan . |
| 5-289552 | 11/1993 | Japan . |
| 5-313527 | 11/1993 | Japan . |
| 8-166732 | 6/1996 | Japan . |

*Primary Examiner*—Robert Beatty
*Attorney, Agent, or Firm*—Burns, Doane, Swecker & Mathis, LLP

[57] ABSTRACT

An image forming apparatus includes an image holding member for forming a toner image, and a transfer roller for transferring the toner image formed on the image holding member onto a recording paper sheet. The absolute value of $(\Delta \log R)/\Delta V[(\log \Omega)/kV]$ representing the voltage dependence of resistance R of the transfer roller is set not more than 0.5. The contacting portion of the transfer roller and an intermediate belt can be uniformly discharged, and therefore intermediate belt can be prevented from being changed in its property. As a result, an image forming apparatus having a stable transfer characteristic can be provided.

5 Claims, 4 Drawing Sheets

IMAGE FORMING APPARATUS CAPABLE OF OBTAINING STABLE TRANSFER USING A PARTICULAR TRANSFER ROLLER

BACKGROUND OF THE INVENTION

1. Field of the Invention

The present invention relates generally to image forming apparatuses, and more particularly, to an image forming apparatus permitting a toner image formed on an image holding member to be transferred onto a recording medium by a transfer roller.

2. Description of the Related Art

FIG. 7 is a perspective view showing an over view of a conventional full-color laser beam printer 5 as seen from its front side, and FIG. 8 is a view showing the structure of the internal mechanism of full-color laser beam printer 5.

Referring to FIG. 8, printer 5 includes a photoreceptor unit 10 having a photoreceptor drum 11 driven to rotate in the direction of arrow a, a laser scanning optical system 20, a full-color developing unit 30, an intermediate transfer unit 40 including an endless intermediate transfer belt 41 driven to rotate in the direction of arrow b, and a paper feed unit 60.

A charging brush 13 and a cleaner 12 are provided around photoreceptor drum 11. Charger brush 13 charges the surface of photoreceptor drum 11 uniformly to a prescribed potential. Cleaner 12 takes away toner remaining on photoreceptor drum 11 by its blade 12*a*.

Laser scanning optical system 20 is of a known type including a laser diode, a polygon mirror 21, and an fθ optical device therein, and image data for each of C (cyan), M (magenta), Y (yellow), and Bk (black) is transferred to the control unit of the system from the host computer. Polygon mirror 21 is driven to rotate by a polygon mirror motor M2. Laser scanning optical system 20 sequentially outputs image data for every color as a laser beam, and exposes photoreceptor drum 11 by scanning. Electrostatic latent images in the colors are sequentially formed on photoreceptor drum 11.

Full-color developing unit 30 is formed by integrally attaching four color developers 31C, 31M, 31Y and 31Bk storing developing agents containing toner of C, M, Y, and Bk, respectively to a developer rack (not shown) which can rotate clockwise around the pivotal axis. Each developer is switched as it rotates every time an electrostatic latent image in each color is formed on photoreceptor drum 11 such that the developing sleeve 32 of a corresponding developer is positioned at a developing position D. Printer 5 uses the rotary type full-color developing unit 30 to make the entire printer compact.

The intermediate transfer belt 41 of intermediate transfer unit 40 is stretched in an endless manner around driving roller 42, support roller 43 and tension rollers 44 and 45, and driven to rotate in the direction of arrow b in synchronization with photoreceptor drum 11. Driving roller 42 and photoreceptor drum 11 are both driven to rotate by a main motor M1. There is provided a single belt mark (not shown) at a side edge of intermediate transfer belt 41 excluding the image region for the purpose of registration of tip ends of color images, and a belt position detection sensor SE1 to detect the position of the belt by detecting the belt mark is provided close to intermediate transfer belt 41.

Intermediate transfer belt 41 is in contact with photoreceptor drum 11 under pressure by a rotatable primary transfer roller 46. Intermediate transfer belt 41 faces a horizontal transport path 65 for recording paper, which will be described, at the portion supported by support roller 43 and is in contact with a rotatable secondary transfer roller 59.

Primary and secondary transfer rollers 46 and 59 are each provided with a known voltage supply unit to supply bias voltage of an opposite polarity to the charging polarity of toner. Primary transfer roller 46 allows a toner image on photoreceptor drum 11 to be transferred onto intermediate transfer belt 41, while secondary transfer roller 59 allows the toner image on intermediate transfer belt 41 to be transferred onto a recording paper sheet.

Cleaner 50 is provided in the space between developing unit 30 and intermediate transfer belt 41. Cleaner 50 has a cleaner blade 51 to remove toner remaining on intermediate transfer belt 1. Blade 51 and secondary transfer roller 59 are provided in the way they can be freely abutted against or detached, in other words in a contactable/separable manner from intermediate transfer belt 41.

Paper feed unit 60 includes a manual feed tray 61 which can be opened/closed on the front side of printer main body 5 (the side on which an operator usually stands), a feed cassette 64 loaded in main body 5 which can be replaced from the front side, a feed roller 62 and a timing roller 63. A stack of recording paper sheets placed on feed tray 61 or recording paper sheets S accommodated in feed cassette 64 in a layered manner are fed to the right in FIG. 8 on a one-sheet basis by the rotation of feed roller 62, synchronized with images formed on intermediate transfer belt 41 by timing roller 63, and sent onto a secondary transfer zone. Horizontal transport path 65 for storing paper sheets S is formed of an air suction belt 66, for example, and there is provided a vertical transport path 71 including transport rollers 72, 73, and 74 from a fixing device 70. Recording paper sheets S are discharged onto the upper surface of printer main body from this vertical transport path 71.

Now, the operation of printer 55 will be described. At the beginning of the printing operation, secondary transfer roller 59 and blade 51 are apart from intermediate transfer belt 41. As the printing operation is initiated, main motor M1 is driven and rotates a photoreceptor drum in the direction of arrow a and intermediate transfer belt 41 in the direction of arrow b at the same circumferential speed. Photoreceptor drum 11 is charged up to a prescribed potential by charging brush 13.

Then, a cyan image is exposed by laser scanning optical system 20, and the electrostatic latent image of the cyan image is formed on photoreceptor drum 11. The electrostatic latent image is immediately developed by developer 31C, and the toner image is transferred onto intermediate transfer belt 41 by a primary transfer zone. Immediately after the primary transfer operation, developer 31M is switched to developing position D, followed by exposure of a magenta image, development thereof and a primary transfer thereof. Similarly, switching to developer 31Y, exposure of a yellow image, development thereof, and a primary transfer thereof follow. Further, switching to developer 31Bk, exposure of a black image, development thereof and a primary transfer thereof are performed to place toner images one after another on intermediate transfer belt 41 for every primary transfer.

After the last primary transfer operation completes, developing unit 30 is switched to developer 31C for the next printing processing, while secondary transfer roller 59 and blade 51 are pressed-contacted to intermediate transfer belt 41. At the time recording paper sheets S are sent into the secondary transfer unit, and a full-color toner image formed on intermediate transfer belt 41 is transferred onto a recording paper sheet S. After the secondary transfer operation, secondary transfer roller 59 and blade 51 are detached from intermediate transfer belt 41.

Recording paper sheet S transferred with the full-color toner image is transported to fixing device 70 by air suction belt 66 for fixation, and discharged onto the upper surface of printer main body 5 by transport rollers 72, 73 and 74.

In such conventional printer 5, a skin-coated roller having a smooth skin layer formed on its surface is used for each of transfer roller 46 and 59. The skin-coated roller which can be reduced to only a limited level in hardness imposes high transfer pressure, which causes void in a solid area of printed characters.

In order to solve the problem of the skin-coated roller, use of a cellular (foamed) roller having a surface formed of a cellular material which can be readily reduced in hardness has been proposed. When used as transfer rollers 46 and 59, however, the cellular roller causes a differential between the transfer efficiencies of the paper passed portion through which a recording paper sheet S of a small width has passed and the non-paper passed portion through which no paper sheet has passed when the width of recording paper sheet S is switched from a small size to a large size, resulting in density variations in images (size memory).

SUMMARY OF THE INVENTION

It is therefore one object of the invention to provide an image forming apparatus which provides a stable transfer characteristic.

Another object of the invention is to provide an image forming apparatus which can prevent the property of an image holding member from being changed.

The above-described objects of the invention are achieved by an image forming apparatus including the following elements. More specifically, the image forming apparatus according to the present invention includes an image holding member having a toner image formed on its surface, and a transfer member to transfer the toner image formed on the image holding member onto a recording medium. The voltage dependence on the resistance value R of the transfer member satisfies the following condition:

$$0<|(\Delta \log R)/\Delta V[(\log \Omega)/kV]|<0.5$$

The transfer member is selected so that the absolute value of the value $(\Delta \log R)/\Delta V[(\log \Omega)/kV]$ representing the voltage dependence of the resistance R is not more than 0.5. The entire contacting portion of the transfer member and the image holding member is uniformly discharged. As a result, locally intense discharge which could change the property of the image holding member is prevented, and a stable transfer characteristic results.

The transfer member is preferably a transfer roller, the surface of which is formed of a cellular material having a mean cellular diameter of not more than 300 $\mu$m.

At least the surface of transfer roller is formed of a cellular material of a mean cellular diameter of not more than 300 $\mu$m. Since the surface of transfer roller is formed of the cellular material, the transfer pressure can be readily lowered, which prevents any void in resulting printed characters. Since the mean cellular diameter is set to a value not more than 300 $\mu$m, the entire contacting portion of the transfer roller and the image holding member is uniformly discharged. Therefore, no locally intense discharged is caused to change the property of the image holding member.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

A full-color laser beam printer according to a first embodiment of the invention is substantially identical to the conventional printer 5 with an essential difference being that cellular (foamed) rollers are used for transfer rollers 46 and 59, and the absolute value of $(\Delta \log R)/\Delta V[(\log \Omega)/kV]$ representing the voltage dependence of the resistance R of each cellular roller is selected to be not more than 0.5. Herein, the resistance R of the cellular roller refers to resistance R across the region between the metallic center shaft of the cellular roller and the entire surface of the cellular roller. Since the other structure and operation are the same as those of the conventional printer 5, the description will not be repeated.

Use of such a cellular roller for each of transfer rollers 46 and 59 permits the transfer pressure to be reduced, so that void in printed characters is no longer encountered, and the size memory is eliminated.

Figure 1:
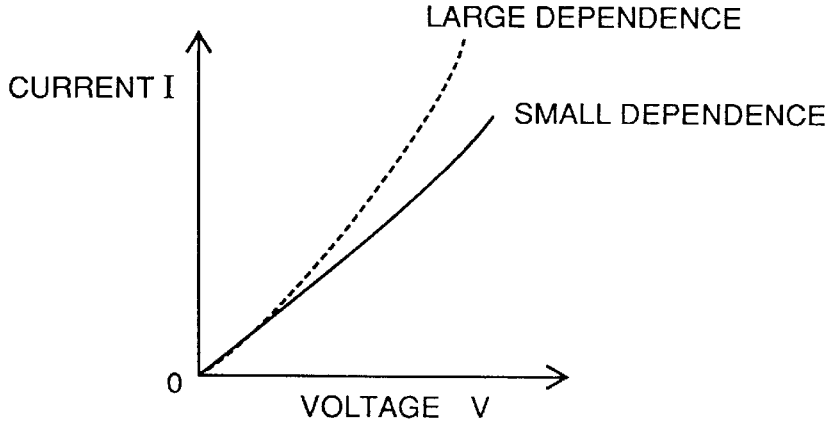
FIG. 1 is a graph for use in illustration of the principle of a full-color laser beam printer according to a first embodiment of the invention.
Figure 2:
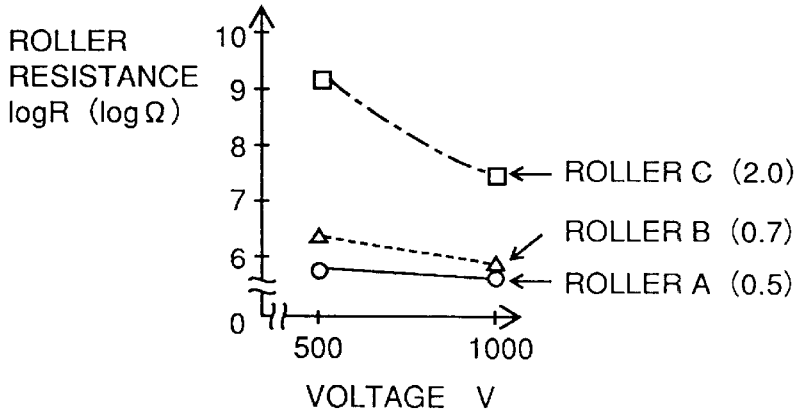
FIG. 2 is a graph showing the voltage dependence of the resistance log R of a transfer roller.

This could be explained as follows. If the value $(\Delta \log R)/\Delta V$ representing the voltage dependence of the resistance R of each of transfer rollers 46 and 59 is greater than 0.5, as current is made to flow, more current is permitted to flow as shown by the dotted line in FIG. 1. As a result, in the non-paper passed portion in which transfer rollers 46 and 59 and intermediate transfer belt 41 are in direct contact, local discharge causes the portion to be discharged to a higher level, while discharge in the surrounding area is impeded, in other words, discharge is not uniformly performed. As the discharge is locally enhanced, the portion exposed to the strong charge has its property and resistance changed. Once the resistance changes, the transfer efficiency changes as well, which causes the size memory.

Meanwhile, if the value $(\Delta \log R)/\Delta V$ representing the resistance R of each of transfer rollers 46 and 59 is not more than 0.5, the current once made to flow is not accelerated any further, and the non-paper passed portion in which transfer rollers 46 and 59 and intermediate transfer belt 41 are in direct contact is uniformly discharged. As a result, the discharge is not locally enhanced, the property of intermediate transfer belt 41 is not changed, and therefore the size memory is not caused.

Now, the present invention will be described in further detail by referring to Example 1 and Comparison Examples 1 and 2.

A printing endurance testing was conducted using intermediate transfer belt 41 formed of a material having about 20% by weight of carbon black as a conductive filler dispersed in ETFE (ethylenetetrafluoroethylene) and a cellular roller A for each of transfer rollers 46 and 59. The voltage (V) dependence of resistance log R (log Ω) of roller A was shown in the solid line in FIG. 1 and the (Δ log R)/ΔV of the roller was 0.5.

Figure 3:
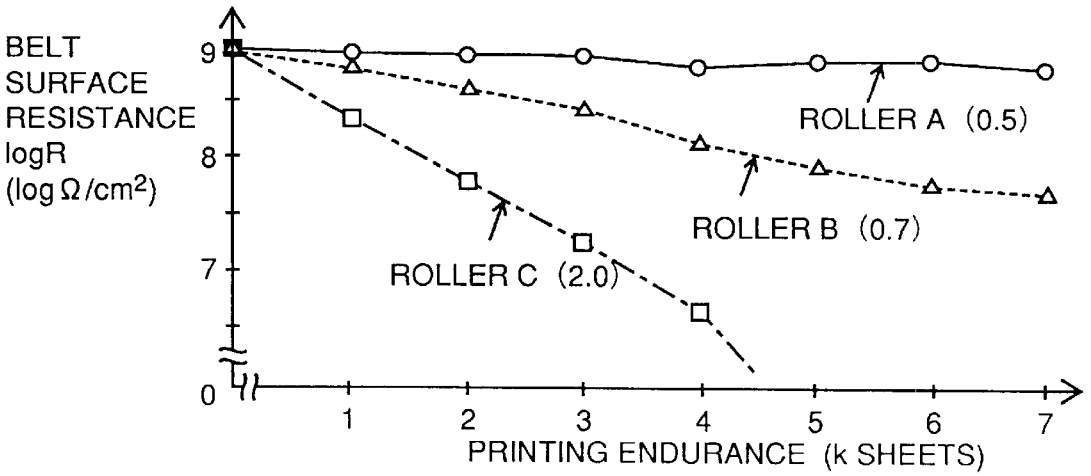
FIG. 3 is a graph showing a result of a printing endurance testing of a transfer roller.
Figure 4:
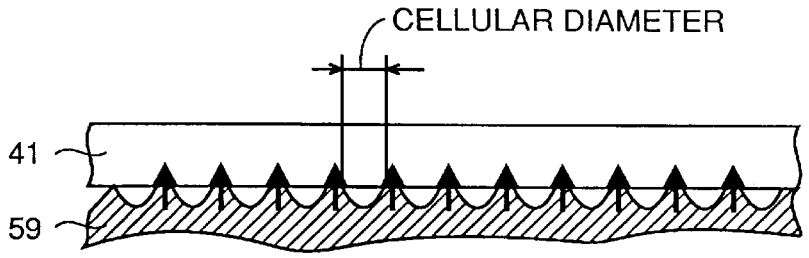
FIG. 4 is a graph for use in illustration of the principle of a full-color laser beam printer according to a second embodiment of the invention.

As shown by the solid line in FIG. 3, the surface resistance log R (log Ω/cm$^2$) of the non-paper passed portion of belt 41 is maintained at the initial value of 9 log Ω/cm$^2$ and not lowered after 7K sheets were passed, and a size memory was not caused.

Comparison Example 1

A printing endurance testing was conducted, using intermediate transfer belt 41 the same as that used in Example 1 and a cellular roller B for each of transfer rollers 46 and 59. The voltage (V) dependence of resistance log R (log Ω) is shown in the solid line in FIG. 1. The value (Δ log R)/ΔV of roller B was 0.7.

As shown in the dotted line in FIG. 3, the surface resistance log R (log Ω/cm$^2$) of the non-paper passed portion of belt 41 was lowered from the initial value of 9 log Ω/cm$^2$ to 8 log Ω/cm$^2$ after 5K sheets were passed, and a light size memory was caused.

Since the value (Ω log R)/ΔV representing the voltage dependence on resistance log R (log Ω) is as great as 0.7, locally intense discharge is caused in the non-paper passed portion, the carbon black dispersed in belt 41 changes in orientation or are coupled with each other to lower the surface resistance log R (log Ω/cm$^2$).

Comparison Example 2

Using intermediate transfer belt 41 the same as that used in Example 1 and a cellular roller C for transfer rollers 46 and 59 were used in a printing endurance testing. The voltage (V) dependence of resistance log R (log Ω) of roller C is shown in the chain-dotted line in FIG. 1, and the (Δ log R)/ΔV of roller C is 2.0.

As shown by the chain-dotted line in FIG. 3, the surface resistance log R (log Ω/cm$^2$) of the non-paper passed portion of belt 41 was lowered from the initial value of 9 log Ω/cm$^2$ to 7 log Ω/cm$^2$ after 3.5K sheets were passed, and a strong size memory was caused.

Note that in Example 1 and Comparison Examples 1 and 2, intermediate transfer belt 41 of a material having carbon black as a conductive filler dispersed in ETFE was used, the same result was obtained using intermediate transfer belt 41 of a material having carbon black as a conductive filler dispersed in polycarbonate.

Note that the mean cellular diameter of the surface of each of cellular rollers A, B and C used in Example 1 and Comparison Examples 1 and 2 is 50 μm.

Second Embodiment

A full-color laser beam printer according to a second embodiment of the invention is substantially identical to conventional printer 5 with an essential difference being that a cellular roller is used for transfer rollers 46 and 59, and the mean cellular diameter of the cellular roller is set to 300 μm or smaller. The other structure and operation are the same as those of the conventional printer 5, and the description will not be repeated.

Use of such a cellular roller for transfer rollers 46 and 59 permits the transfer pressure to be reduced, which prevents void in printed characters as well as a size memory.

This may be explained as follows. If the mean cellular diameter of a cellular roller is as small as 300 μm or smaller, the discharge current is uniformly passed across the entire contacting portion of transfer roller 59 and belt 41. Therefore, no great discharge current is locally passed to cause belt 41 to be changed in property and no size memory is caused.

Figure 5:
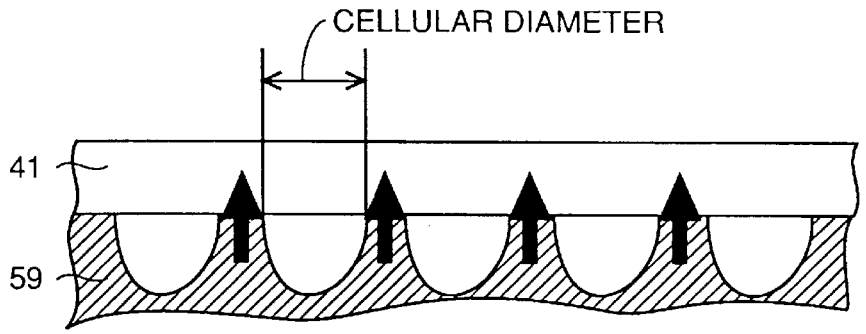
FIG. 5 is another graph for use in illustration of the principle of the full-color laser beam printer according to the second embodiment.

Meanwhile, if the mean cellular diameter of the cellular roller is greater than 300 μm, as shown in FIG. 5, the discharge current is locally concentrated, and the great discharge current changes the property and resistance of belt 41. Once the resistance changes, the transfer efficiency changes, and a size memory results.

Now, the present invention will be described in further detail by referring to Example 2 and Comparison Examples 3 and 4.

EXAMPLE 2

Using intermediate transfer belt 41 manufactured by Mitsubishi Chemicals of a material having about 20% by weight of carbon black dispersed in ETFE as a conductive filler, and a cellular roller D having a mean cellular diameter of 50 μm in a printing endurance testing. As shown by the solid line in FIG. 6, the surface resistance log R (log Ω/cm$^2$) of the non-paper passed portion of belt 41 was maintained at the initial value of 9 log Ω/cm$^2$ and not lowered at all after 7K sheets were passed, and no size memory was caused.

Comparison Example 3

Using intermediate belt 41 the same as that used in Example 2 and a cellular roller E having a mean cellular diameter of 200 μm for transfer rollers 46 and 54, a printing endurance testing was conducted.

Figure 6:
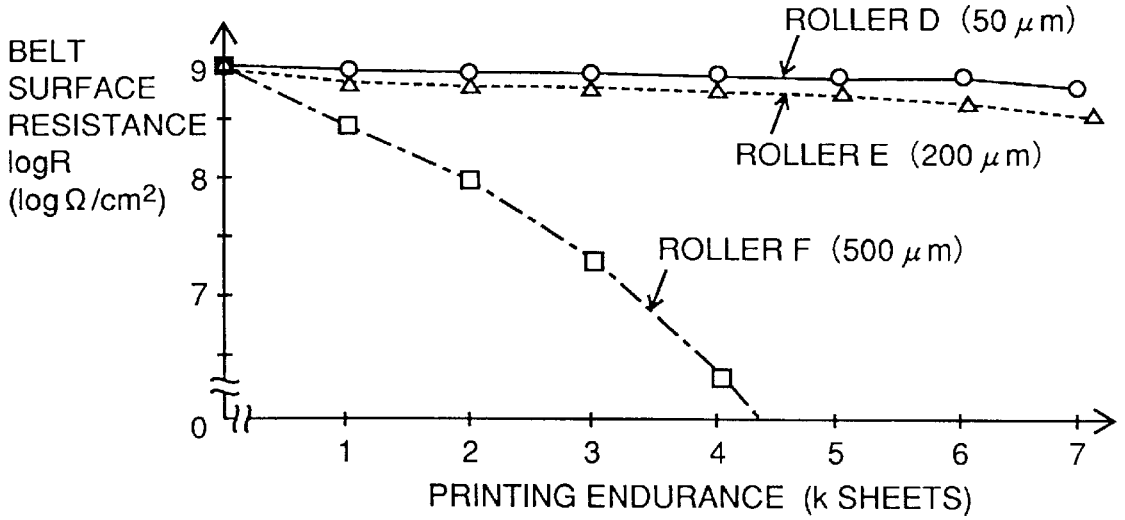
FIG. 6 is a graph showing a result of a printing endurance testing of a transfer roller.
Figure 7:
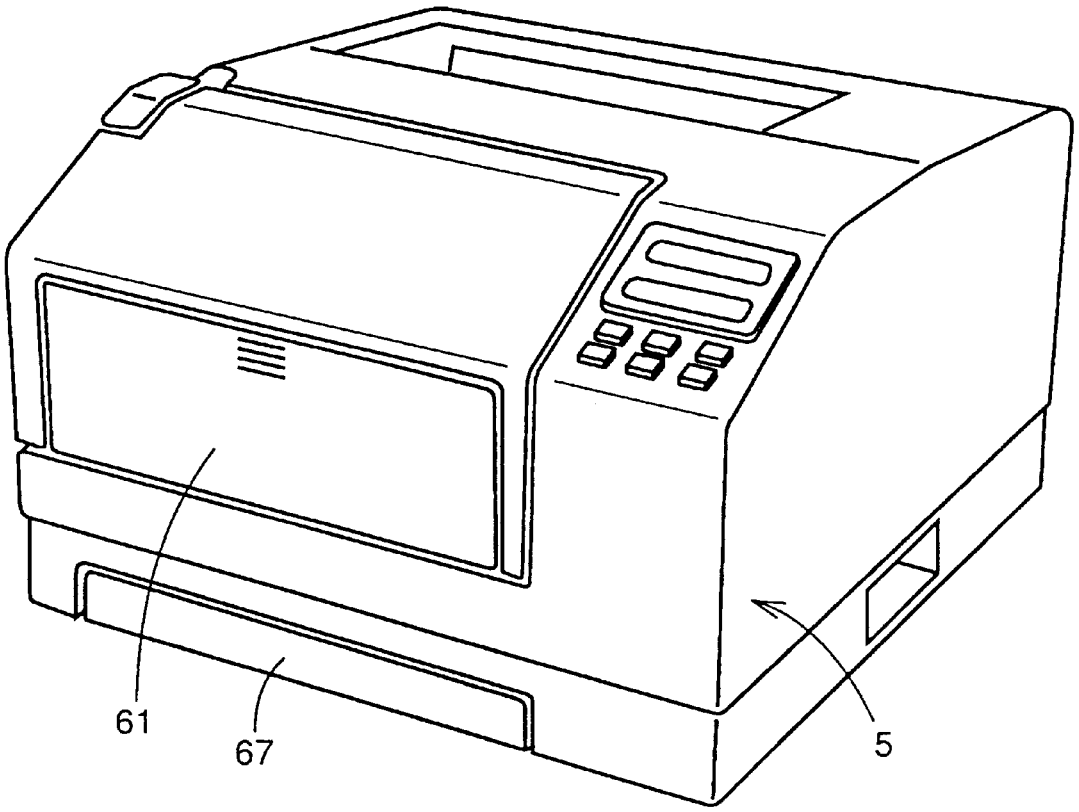
FIG. 7 PRIOR ART
FIG. 7 is a perspective view showing an overview of a conventional full-color laser beam printer seen from the front.
Figure 8:
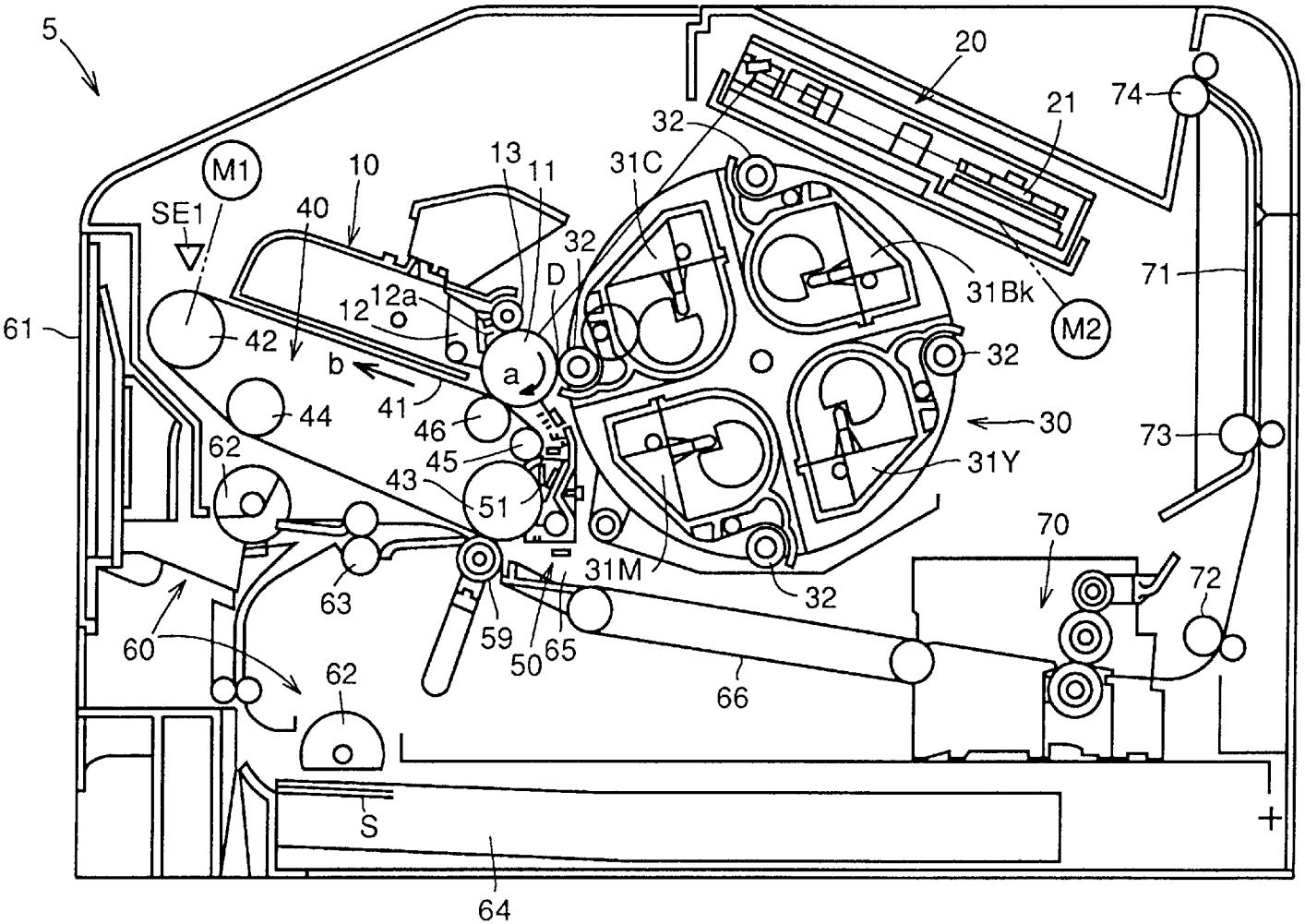
FIG. 8 PRIOR ART
FIG. 8 is a view schematically showing the internal mechanism of the full-color laser beam printer shown in FIG. 7.

As shown in the dotted line in FIG. 6, the surface resistance log R(log Ω/cm$^2$) of the non-paper passed portion of belt 41 was maintained almost at the level of the initial values of 9 log Ω/cm$^2$, and no size memory was caused.

Comparison Example 4

Using intermediate belt 41 of the same material as that of Example 2, and a cellular roller F having a mean cellular diameter of 500 μm, a printing endurance testing was conducted.

As shown in the chain-dotted line in FIG. 6, the surface resistance log R(log Ω/cm$^2$) of the non-paper passed portion of belt 41 was lowered from the initial value of 9 log Ω/cm$^2$ to 6.5 log Ω/cm$^2$, and a size memory was caused.

Since the mean cellular diameter of each of transfer rollers 46 and 59 is as great as 500 μm, locally intense discharge was caused in the non-paper passed portion, carbon dispersed in belt 41 would have been changed or coupled with each other to lower the surface resistance log R (log Ω/cm$^2$).

Note that in Example 2 and Comparison Examples 3 and 4, intermediate transfer belt 41 of a material having carbon black dispersed as a conductive filler in ETFE was used, but the same result was obtained using intermediate transfer belt 41 of a material having carbon black dispersed as a conductive filler in polycarbonate.

Note that as to the voltage dependence of cellular rollers D, E and F used in Example 2 and Comparison Examples 3 and 4, the $(\Delta \log R)/\Delta V$ of each roller was 0.5, the same as cellular roller A used in Example 1.

Note that if a semiconductive transfer roller is used in the primary transfer operation using the intermediate transfer belt, the resistance of the belt does not change depending upon difference in the discharge level caused by the presence/absence of toner, a pattern memory is not caused, and the same effects as those in the first and second embodiments are provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a photoreceptor having a surface on which a toner image may be formed;

an intermediate transfer belt disposed in abutment against said photoreceptor, said belt being formed of a high resistance material having a conductive filler dispersed therein, said belt being provided with a prescribed voltage in the abutment position;

a transfer roller pressing said intermediate transfer belt against said photoreceptor and being provided with the prescribed voltage, said transfer roller having a surface formed of a cellular material having open cells in contact with said intermediate transfer belt, wherein the voltage dependence of resistance value R of said transfer roller satisfies the following condition:

$$0<|(\Delta \log R)/\Delta V[(\log \Omega)/kV]|<0.5.$$

2. The apparatus as recited in claim 1, further comprising another transfer roller pressing said intermediate transfer belt into contact with a recording medium.

3. The apparatus as recited in claim 2, wherein said transfer rollers each have a surface formed of a cellular material having a mean cellular diameter of not more than 300 $\mu$m.

4. An image forming method comprising the steps of:

forming a toner image on an intermediate transfer belt disposed in abutment against a photoreceptor, said belt being formed of a high resistance material having a conductive filler dispersed therein;

providing said belt with a prescribed voltage at the location where said belt abuts said photoreceptor;

pressing a recording medium against the intermediate transfer belt with a transfer roller, said transfer roller having a surface formed of a cellular material having open cells in contact with said intermediate transfer belt; and supplying a prescribed voltage to the transfer roller, the voltage dependence of resistance value R of the transfer roller satisfying the following condition:

$$0<|(\Delta \log R)/\Delta V[(\log \Omega)/kV]|<0.5.$$

5. An image forming apparatus comprising:

an image holding member having a toner image formed on its surface;

an intermediate transfer belt disposed in abutment against said image holding member, the belt is formed of high resistance material having a conductive filler dispersed therein, and the belt is provided with a prescribed voltage in the abutment position, a transfer roller pressing a recording medium against said intermediate transfer belt and provided with a prescribed voltage, wherein the surface of said transfer roller is formed of a cellular material having a mean cellular diameter of not more than 300 $\mu$m and having open cells in contact with the belt, wherein the voltage dependence of resistance value R of said transfer member satisfies the following condition:

$$0<|(\Delta \log R)/\Delta V[(\log \Omega)/kV]|<0.5.$$

* * * * *